US010478376B2

(12) United States Patent
Tran et al.

(10) Patent No.: US 10,478,376 B2
(45) **Date of Patent: *Nov. 19, 2019**

(54) FOOT SPA WITH ILLUMINATION

(71) Applicant: Gulfstream Inc., Cambridge (CA)

(72) Inventors: Minh Sang Tran, Cambridge (CA); Chris Alexander, Cambridge (CA)

(73) Assignee: Gulfstream Inc., Cambridge, ON (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/669,700

(22) Filed: Aug. 4, 2017

(65) Prior Publication Data

US 2018/0042812 A1 Feb. 15, 2018

Related U.S. Application Data

(60) Provisional application No. 62/372,361, filed on Aug. 9, 2016, provisional application No. 62/393,845, filed on Sep. 13, 2016.

(51) Int. Cl.

| | |
|---|---|
| ***A61H 33/00*** | (2006.01) |
| ***A61H 35/00*** | (2006.01) |
| ***F04D 29/62*** | (2006.01) |
| ***F04D 29/00*** | (2006.01) |
| ***F04D 13/02*** | (2006.01) |
| ***F21W 131/401*** | (2006.01) |

(52) U.S. Cl.

CPC ..... *A61H 33/6047* (2013.01); *A61H 33/0091* (2013.01); *A61H 35/006* (2013.01); *F04D 13/024* (2013.01); *F04D 29/005* (2013.01); *F04D 29/628* (2013.01); *A61H 2033/0083* (2013.01); *F21W 2131/401* (2013.01)

(58) Field of Classification Search

CPC ..... A61H 33/60
USPC ..... 4/541.1–541.6
See application file for complete search history.

(56) References Cited

U.S. PATENT DOCUMENTS

| | | | |
|---|---|---|---|
| 7,393,188 | B2 | 7/2008 | Lawyer et al. |
| 7,571,867 | B2 | 8/2009 | Hu |
| 8,366,418 | B2 | 2/2013 | Tran et al. |
| 8,531,048 | B2 | 9/2013 | Tran et al. |
| 8,680,699 | B2 | 3/2014 | Tran et al. |
| 9,572,747 | B2 | 2/2017 | Tran et al. |
| 2003/0076692 | A1 | 4/2003 | Love |
| 2003/0210993 | A1 | 11/2003 | Sabini et al. |
| 2005/0120473 | A1 | 6/2005 | Southon |
| 2006/0036198 | A1 | 2/2006 | Cafaro et al. |
| 2007/0245480 | A1 | 10/2007 | Sorensen et al. |
| 2011/0012355 | A1 | 1/2011 | Liao et al. |
| 2011/0012359 | A1 | 1/2011 | Liao et al. |

(Continued)

FOREIGN PATENT DOCUMENTS

| | | | |
|---|---|---|---|
| CA | 2706306 | A1 | 12/2010 |

*Primary Examiner* — Lori L Baker
(74) *Attorney, Agent, or Firm* — Avery N. Goldstein; Blue Filament Law PLLC

(57) ABSTRACT

An illuminated foot spa is provided. The foot spa has a surface which defines a basin for containing water and a pump magnetically driven by rotating magnets. A mount defines part of the surface and holds the pump against rotation. A coil associated with the mount and disposed exteriorly of the surface of the basin and interiorly of a magnetic field produced by the rotating magnets to produce a current in the coil that powers a plurality of lights operatively connected to the coil. The light conductivity associated with the mount permits the plurality of lights to be visible interiorly of the basin.

4 Claims, 21 Drawing Sheets

(56) References Cited

U.S. PATENT DOCUMENTS

| | | | |
|---|---|---|---|
| 2013/0269098 | A1 | 10/2013 | Tran |
| 2017/0071822 | A1 | 3/2017 | Tran |

FOOT SPA WITH ILLUMINATION

RELATED APPLICATIONS

This application is a non-provisional application that claims priority benefit of U.S. Provisional Application Ser. No. 62/372,361 filed Aug. 9, 2016; and U.S. Provisional Application Ser. No. 62/393,845 filed Sep. 13, 2016; the contents of which are both hereby incorporated by reference.

FIELD OF THE INVENTION

The invention relates to the field of foot spas.

BACKGROUND OF THE INVENTION

Illuminated foot spas are known. A common method for illuminating a foot spa is to use LED lights powered by an AC-DC converter connected to line voltage.

SUMMARY OF THE INVENTION

Forming one aspect of the invention is an improved mount of the type used in a foot spa, the foot spa being of the type having a surface defining a basin for containing water, a pump magnetically driven by rotating magnets and held against rotation by the mount which also defines part of the surface. The improvement comprises: a coil associated with the mount and disposed exteriorly of the surface of the basin and interiorly of the magnetic field produced by the rotating magnets to produce a current; a plurality of lights operatively connected to the coil; and light conductivity associated with the mount to permit the light to be visible interiorly of the basin.

According to another aspect, the mount can be one of translucent and transparent to provide said light conductivity.

According to another aspect, the mount can include a receiver and the coil can be releasably received by the receiver.

According to another aspect, the coil can be formed integrally with the mount.

According to another aspect, the mount can define a platform and can further comprise a circuit board releasably received by the platform and operatively coupling the coil to the lights.

According to another aspect, the cover portion can have receivers which engage plugs on the circuit board, and the circuit board can have receivers which can engage plug ends of removable cords.

According to another aspect, each of the lights can be associated with one of a plurality of modules, each module including a pair of plugs and a clip, one of the modules including a circuit board; and in use, the clip of each module can be secured to one of the posts and the modules can be plugged together.

Advantages, features and characteristics of the invention will become apparent upon review of the following detailed description and the appended drawings, the latter being briefly described hereinafter.

BRIEF DESCRIPTION OF THE DRAWINGS

FIG. 17.

DETAILED DESCRIPTION OF THE INVENTION

Figure 1:
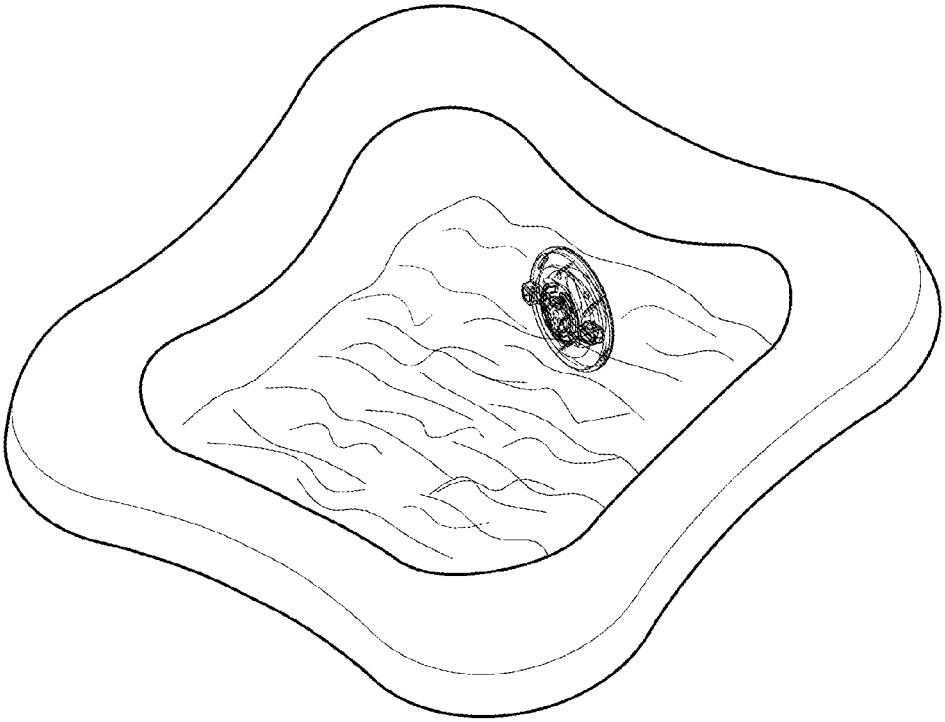
FIG. 1 is a perspective view of a basin constructed according to an exemplary embodiment of the invention, in use.
Figure 2:
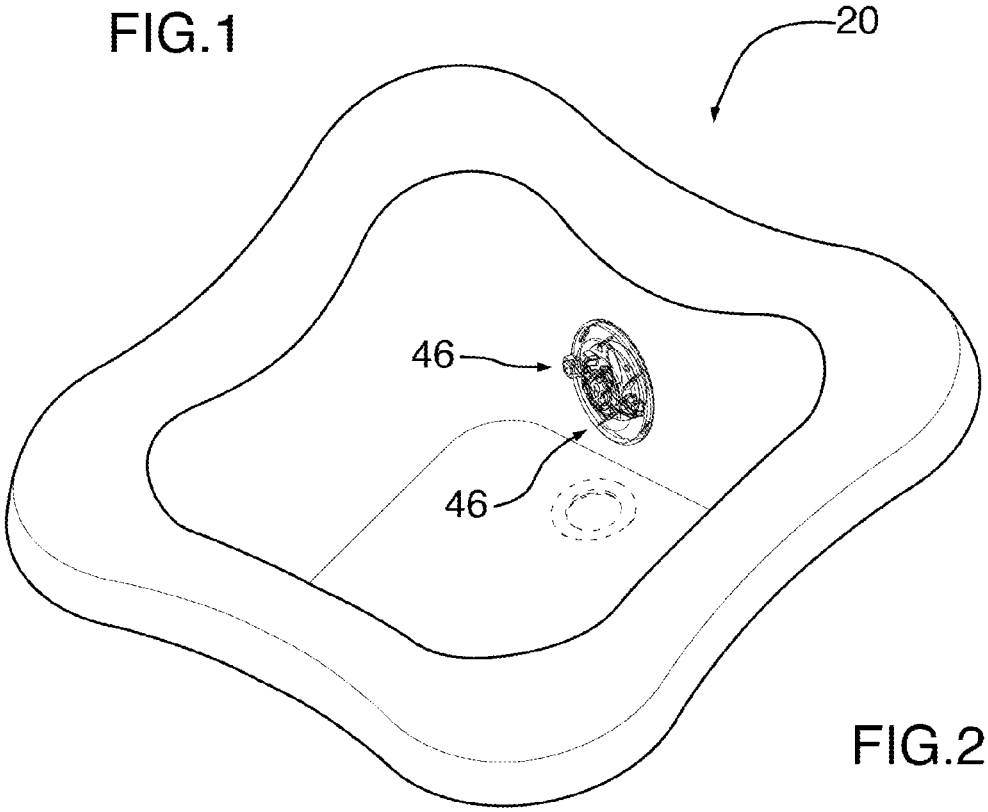
FIG. 2 is a view of the structure of FIG. 1 with the water and plug removed.
Figure 3:
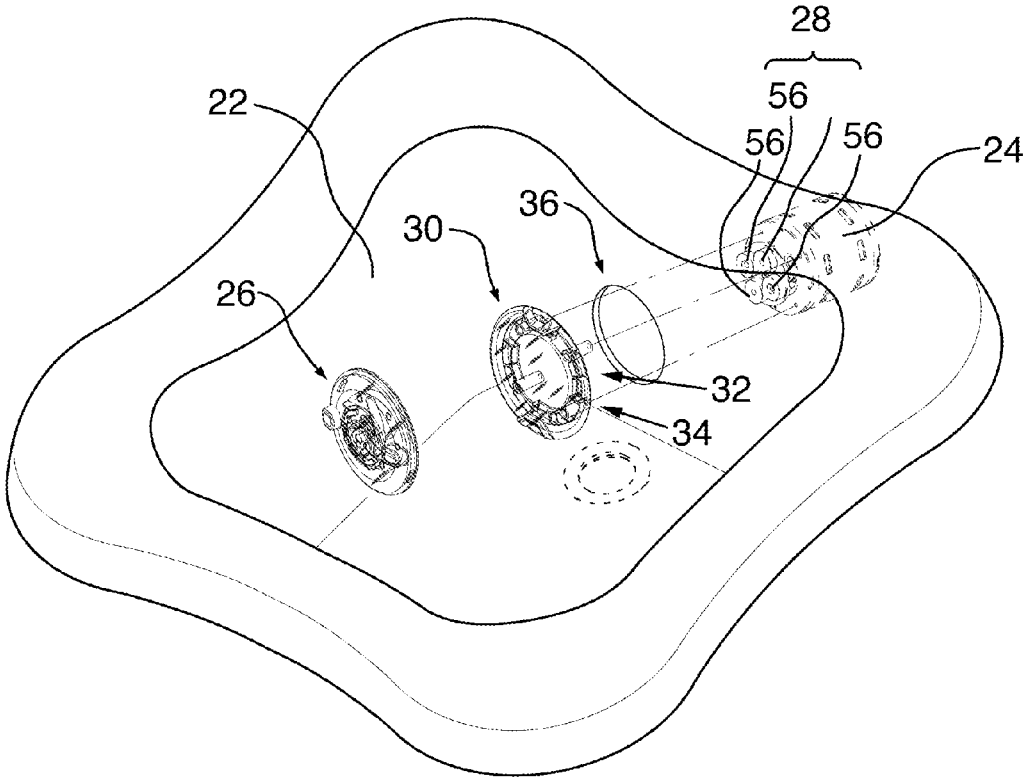
FIG. 3 is an exploded view of the structure of FIG. 2.
Figure 4:
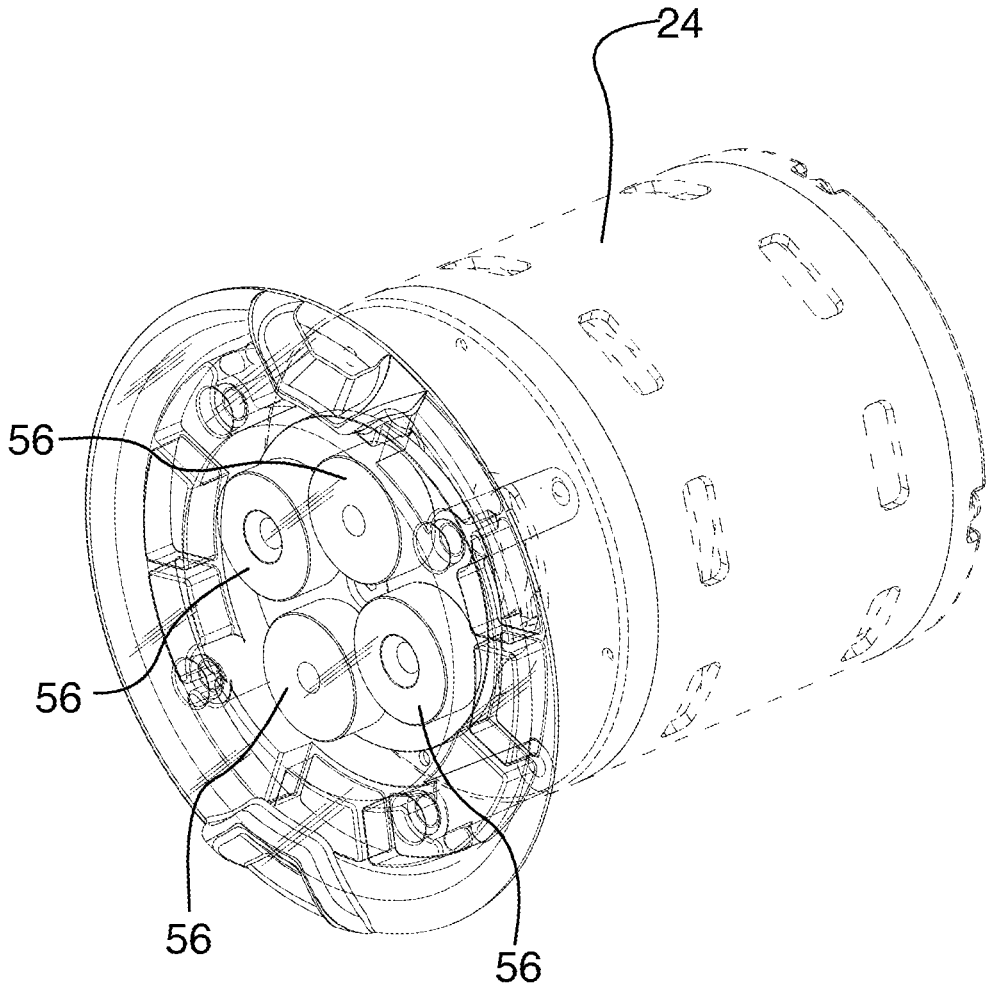
FIG. 4 is an enlarged view of a portion of FIG. 3.
Figure 5:
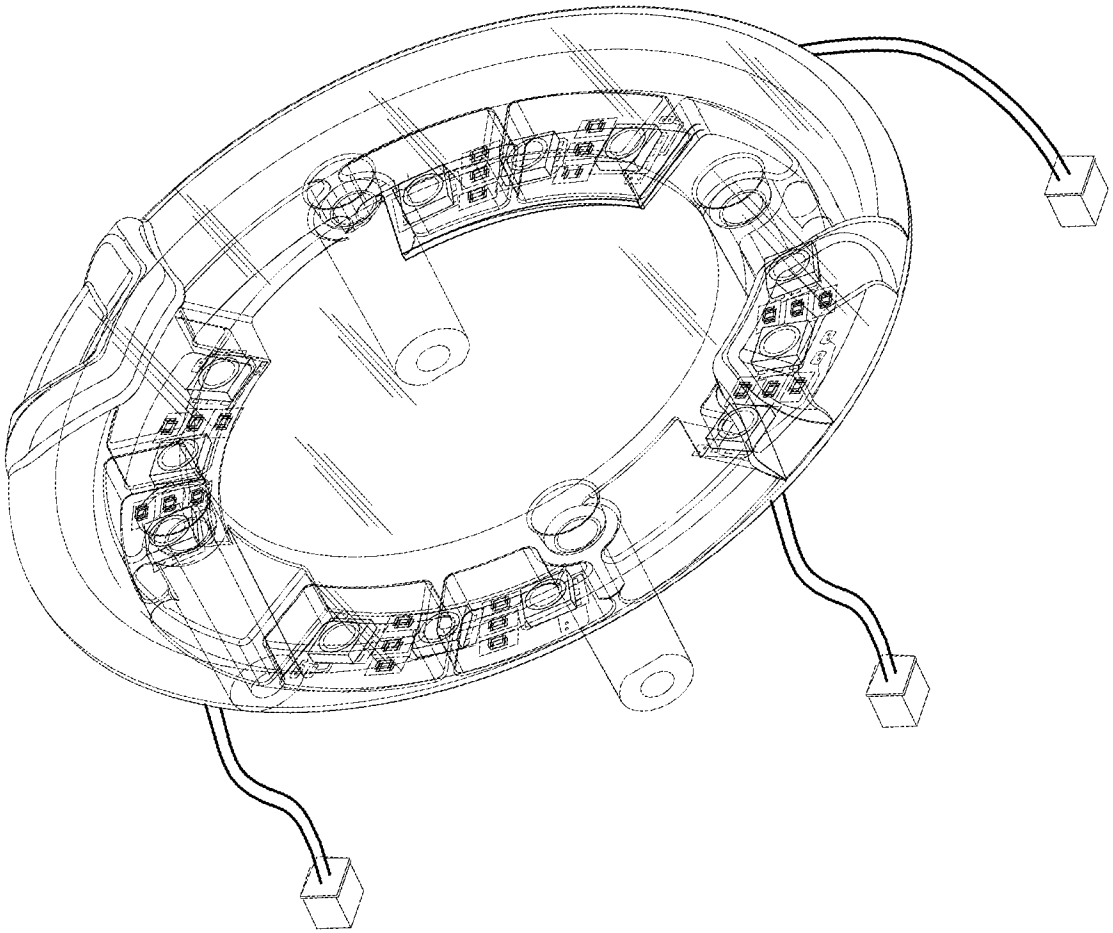
FIG. 5 is an enlarged view of a portion of FIG. 4.

An exemplary embodiment of the invention 20 is shown in FIGS. 1-10 and will be seen in FIG. 3 to include: a basin 22; a motor 24; a pump 26; a drive head 28; a mount 30; a light part 32; and a charge part 34.

The basin 22 has an aperture 36.

Figure 6:
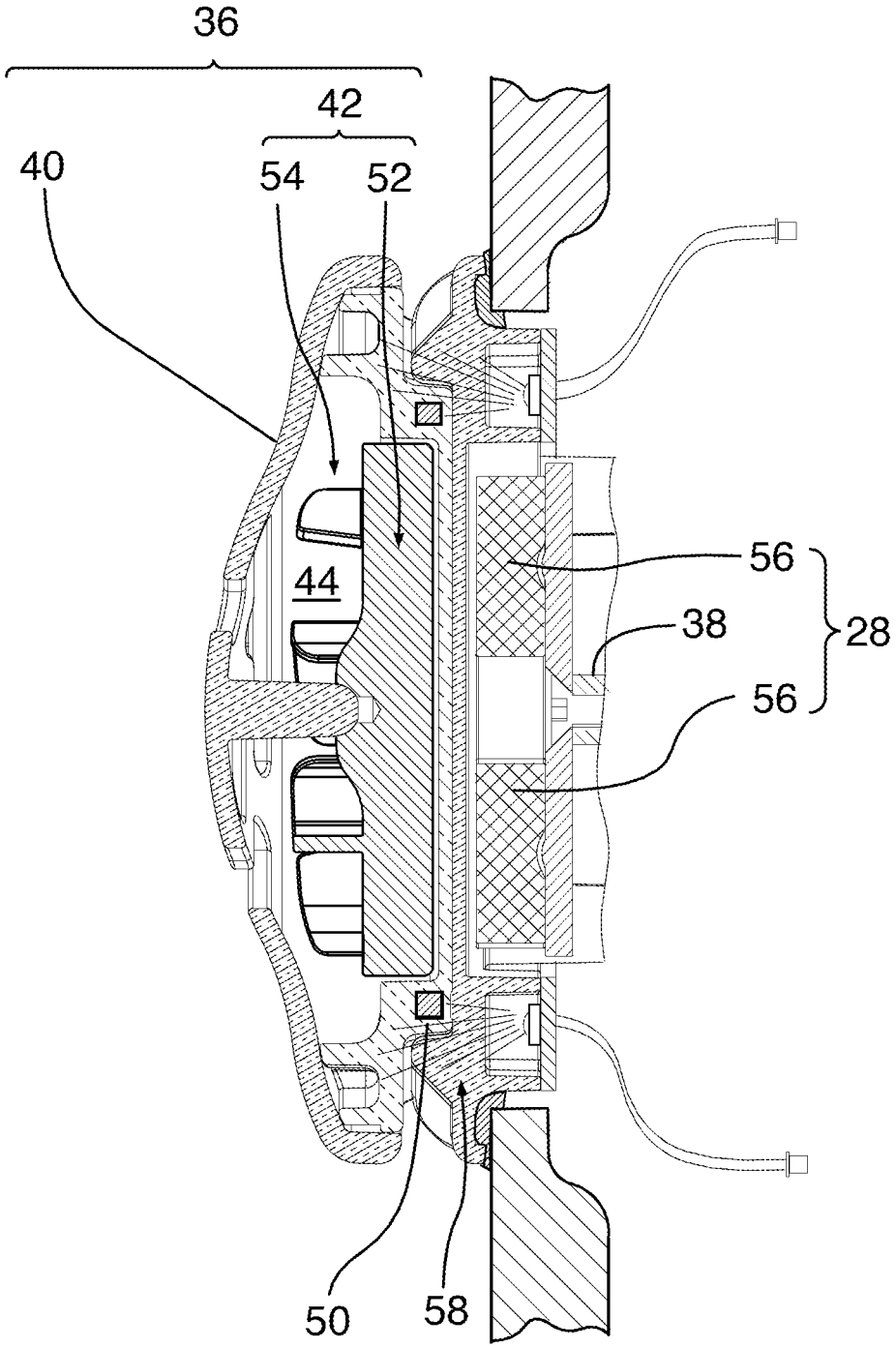
FIG. 6 is a cross-sectional view of the structure of FIG. 2.

With reference to FIG. 6, the motor 24 will be seen to have a shaft 38 and, with reference to FIG. 2 and FIG. 6, the pump 26 will be seen to include a housing 40 and a rotor 42. The housing 40 defines: a cavity 44; a pair of outlet ports 46 communicating with the cavity 44; an intake 48 communicating with the cavity 44; and a pin portion 50. The rotor 42 is mounted in the cavity 44 and includes a body part 52 and an impeller part 54.

The drive head 28 comprises a plurality of magnets 56.

Figure 8:
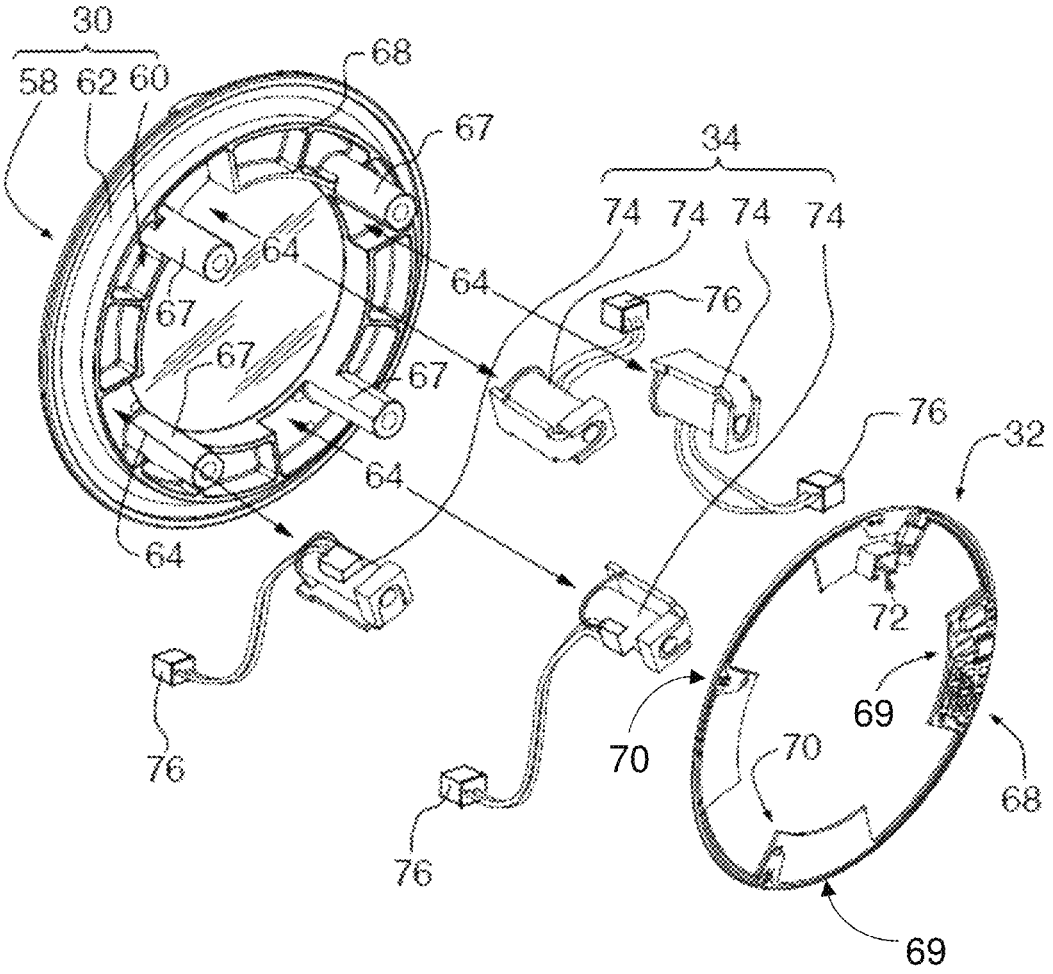
FIG. 8 is an exploded view of the structure of FIG. 7.

With reference to FIG. 8, the mount 30 will be understood to be constructed of translucent plastic and includes a socket portion 58, a receiver portion 60 and a cover portion 62. The receiver portion 60 includes a plurality of receivers 64, a plurality of posts 67 and a platform 69.

The light part 32 includes a circuit board 68, a plurality of lights 70 and a receptacle 72.

The charge part 34 includes a plurality of coils 74. Each coil 74 terminates in a plug 76.

In use:

the cover portion 62 is mounted to the basin 22 to seal the aperture 36;

the basin 22 is filled with water;

the motor 24 is mounted exteriorly of the basin 22;

the drive head 28 is mounted to the shaft 38;

the rotor body part 52 is magnetically attracted to the magnets 56;

the pin portion 50 of the housing 40 is restrained against rotation by the socket portion 58 of the mount 30;

the circuit board 68 is fitted to the platform 69;

the coils 74 are fitted in the receivers 64;

one of the plugs 76 is fitted in the receptacle 72;

rotation of the motor 24 causes rotation of the magnets 56;

rotation of the magnets 56 causes rotation of the rotor body part 52 by induced magnetic fields;

rotation of the rotor body part 52 causes rotation of the impeller part 54 and a voltage differential to be produced in the coils 74;

rotation of the impeller part 54 causes water, that enters the cavity 44 through the intake 48, to be forced through the outlet ports 46;

the coil 74 coupled to the circuit board 68 produces power for the lights 70; and the basin 22 is illuminated by the lights 70.

The remaining plugs 76 can be coupled to other devices (not shown).

It will be evident that variations of the above are possible.

Figure 7:
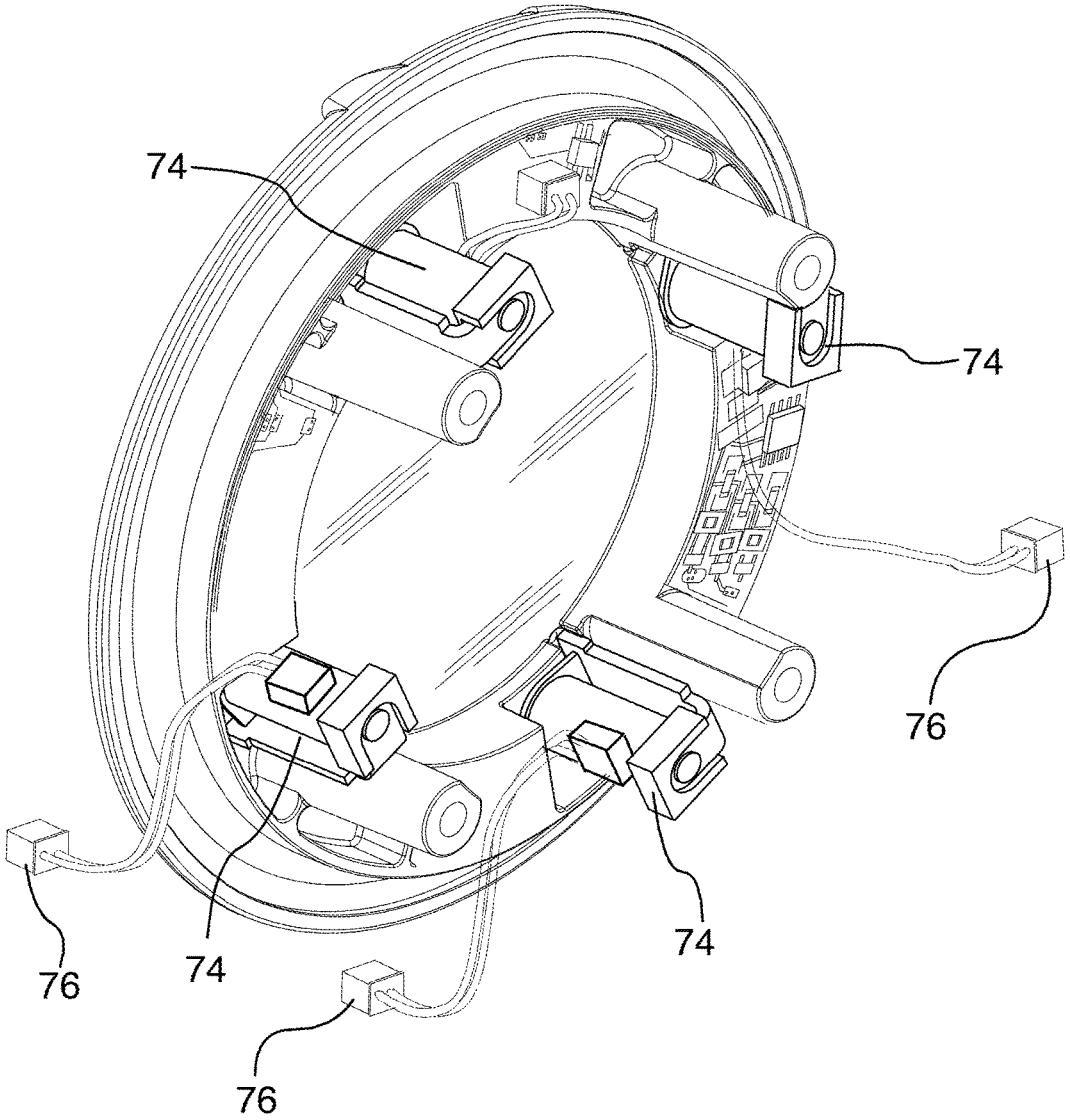
FIG. 7 is a rear view of the structure of FIG. 5.
Figure 11A:
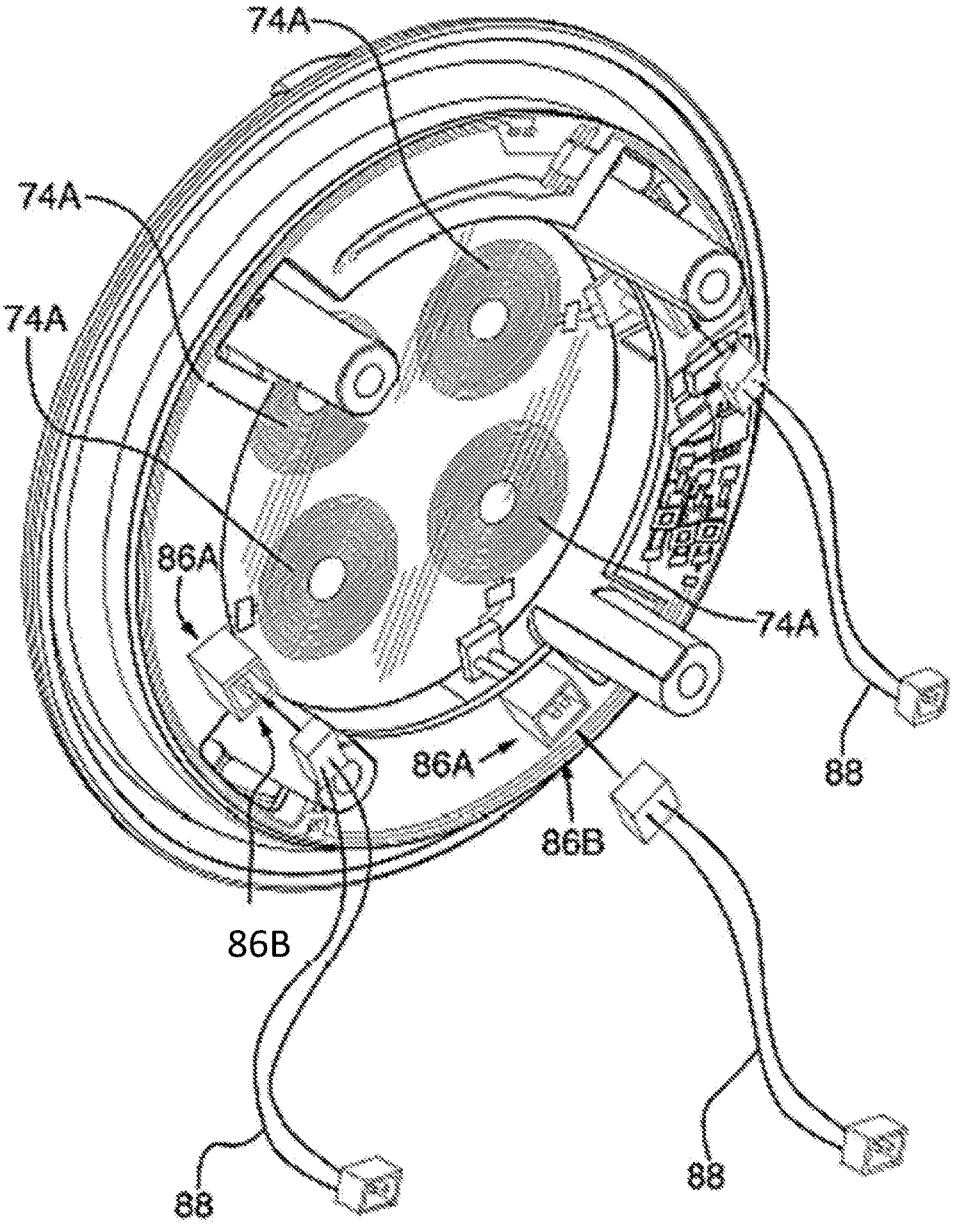
FIG. 11A is a view of a variation of the structure of FIG. 7.
Figure 11B:
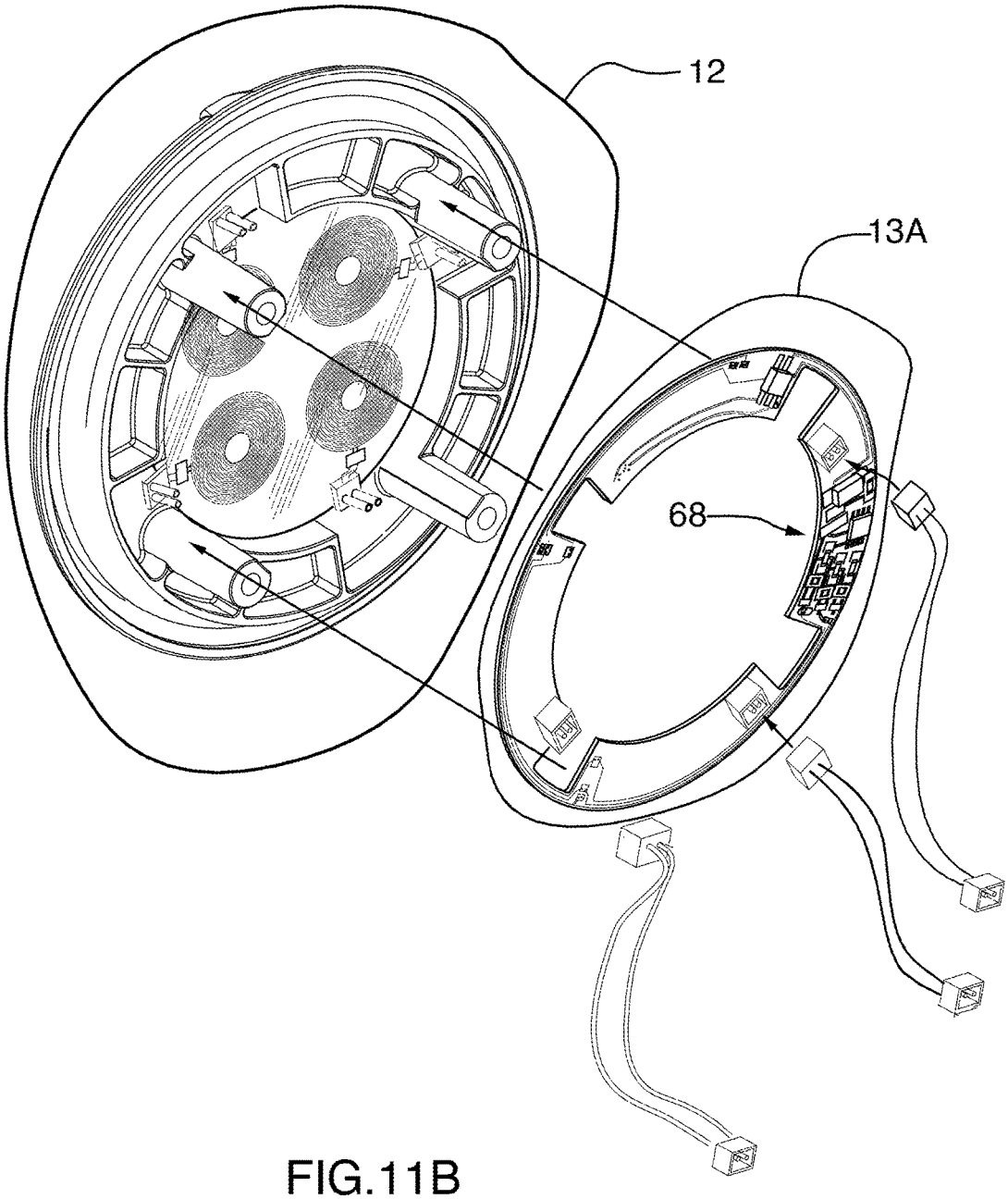
FIG. 11B is an exploded view of the structure of FIG. 11.
Figure 12:
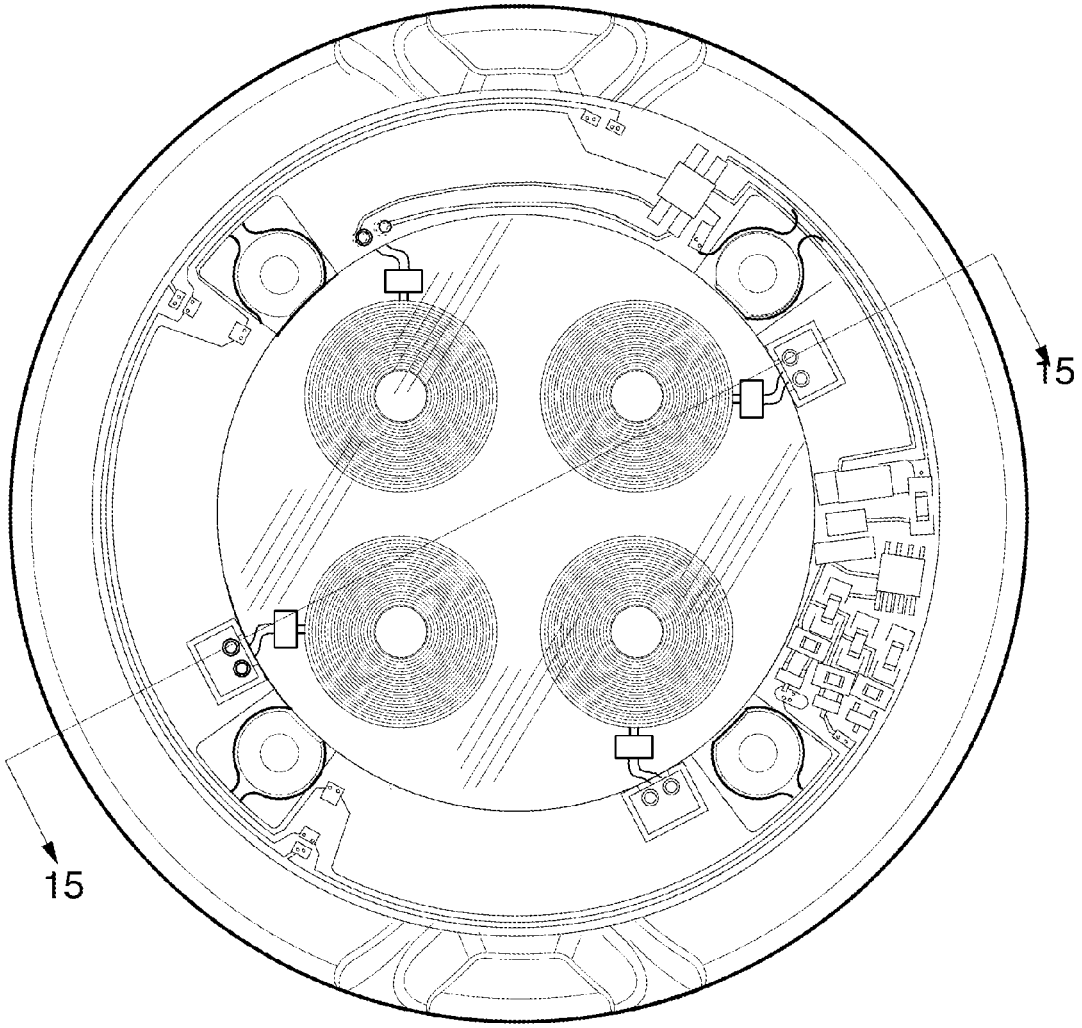
FIG. 12 is a plan view of encircled area 12 of FIG. 11B.
Figure 12A:
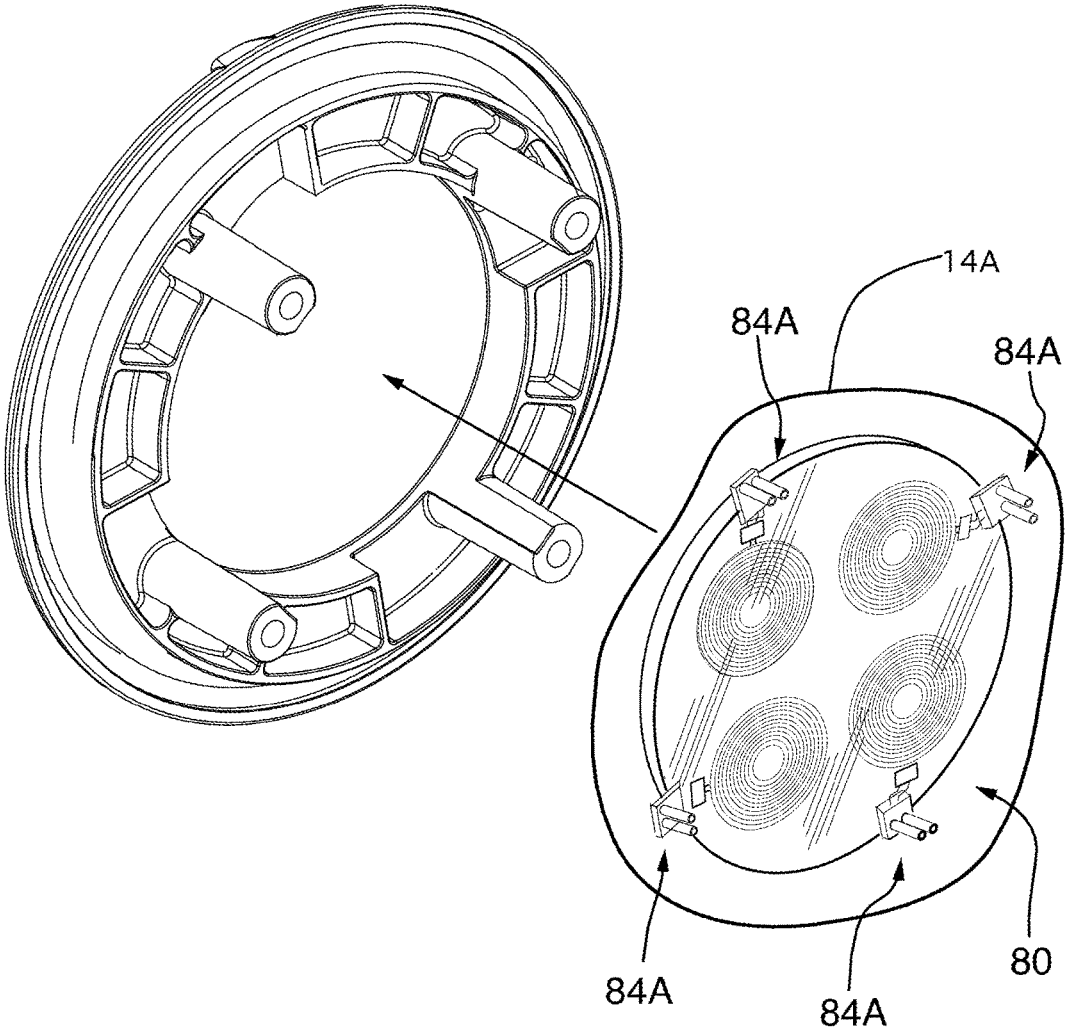
FIG. 12A is an exploded view of the structure of FIG. 12.
Figure 13B:
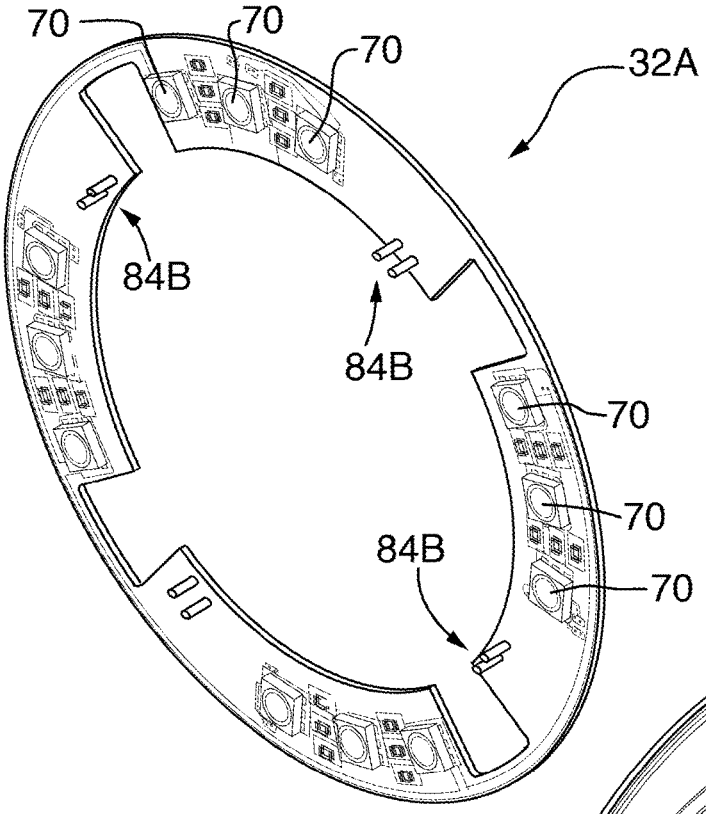
FIG. 13B is a rear view of the structure of FIG. 13A.
Figure 13A:
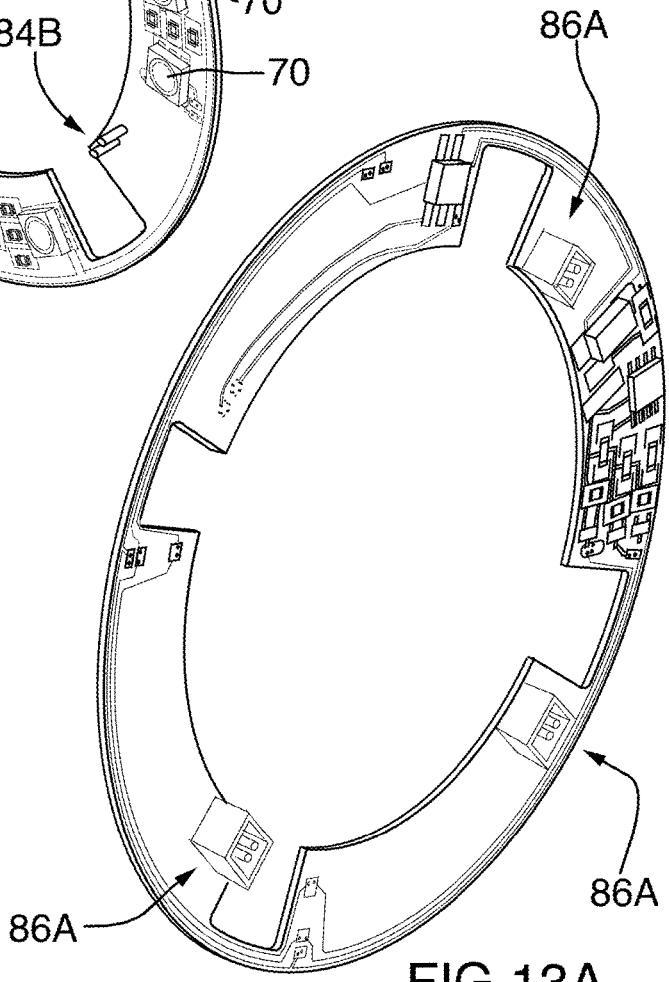
FIG. 13A is an enlarged view of the structure of encircled area 13A of FIG. 11B.

For example, a variation of the structure shown in FIG. 7 is shown in FIGs. 11A and 11B.

Figure 14A:
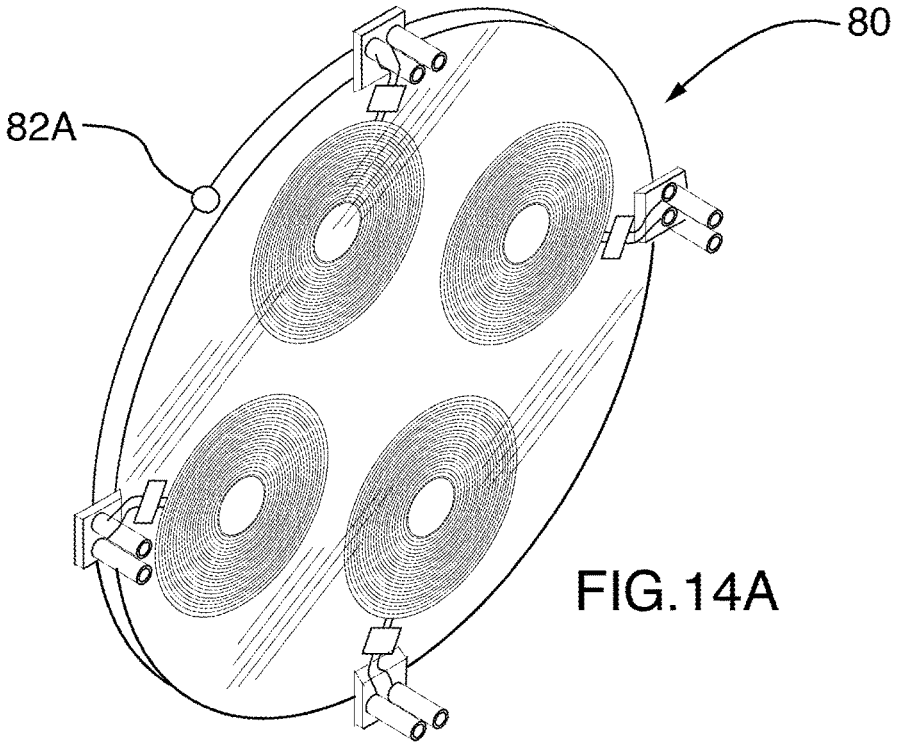
FIG. 14A is an enlarged view of the structure of encircled area 14A of FIG. 12A.
Figure 14C:
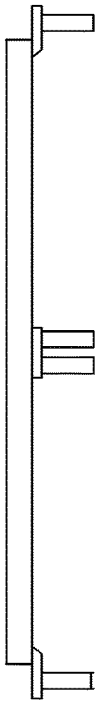
FIG. 14C is a side view of the structure of FIG. 14A.
Figure 14B:
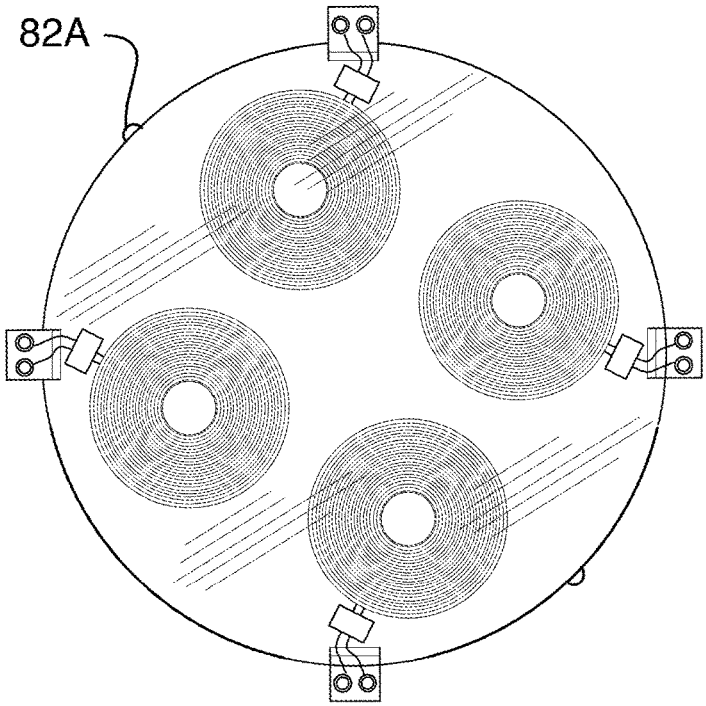
FIG. 14B is a plan view of the structure of FIG. 14A.
Figure 15:
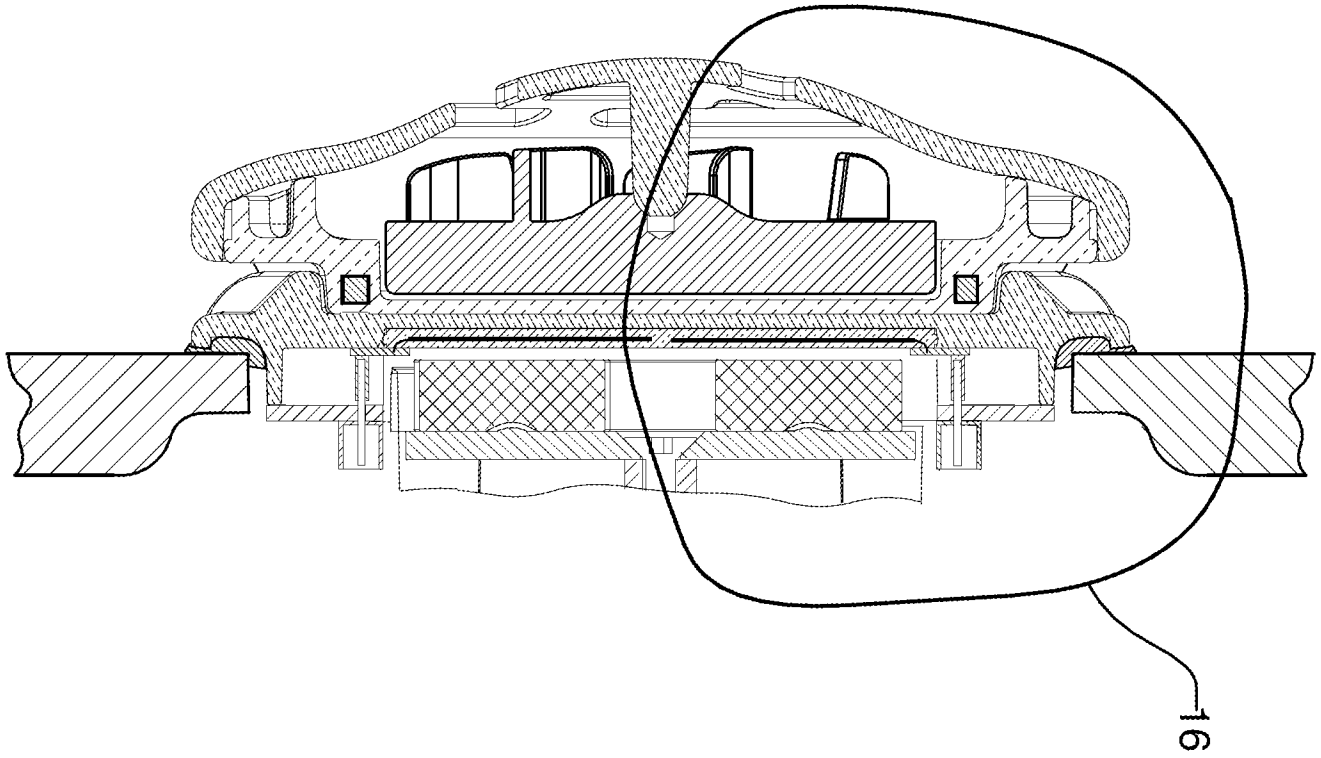
FIG. 15 is a view along section 15-15 of FIG. 12.
Figure 16:
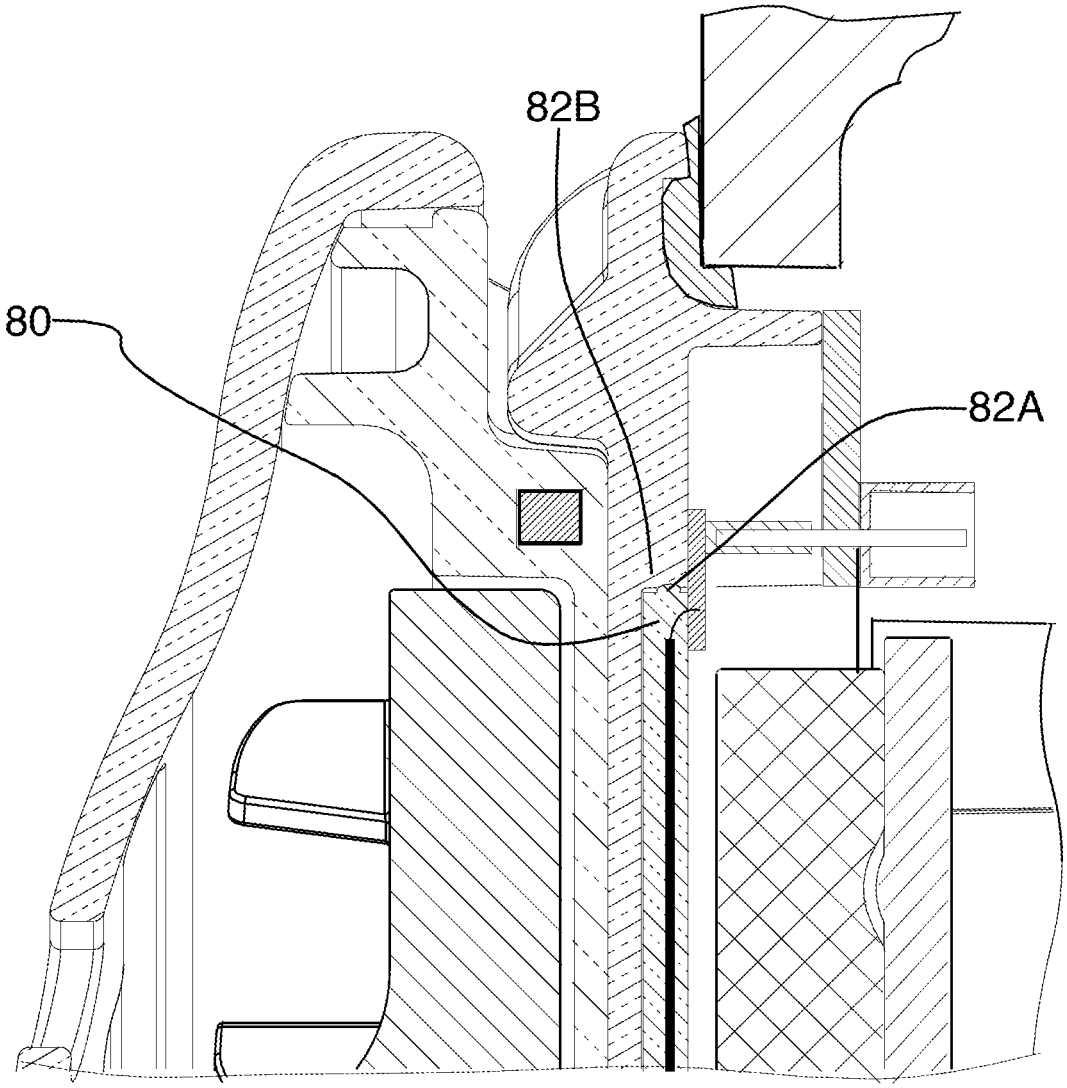
FIG. 16 is an enlarged view of encircled area 16 of FIG. 15.
Figure 17:
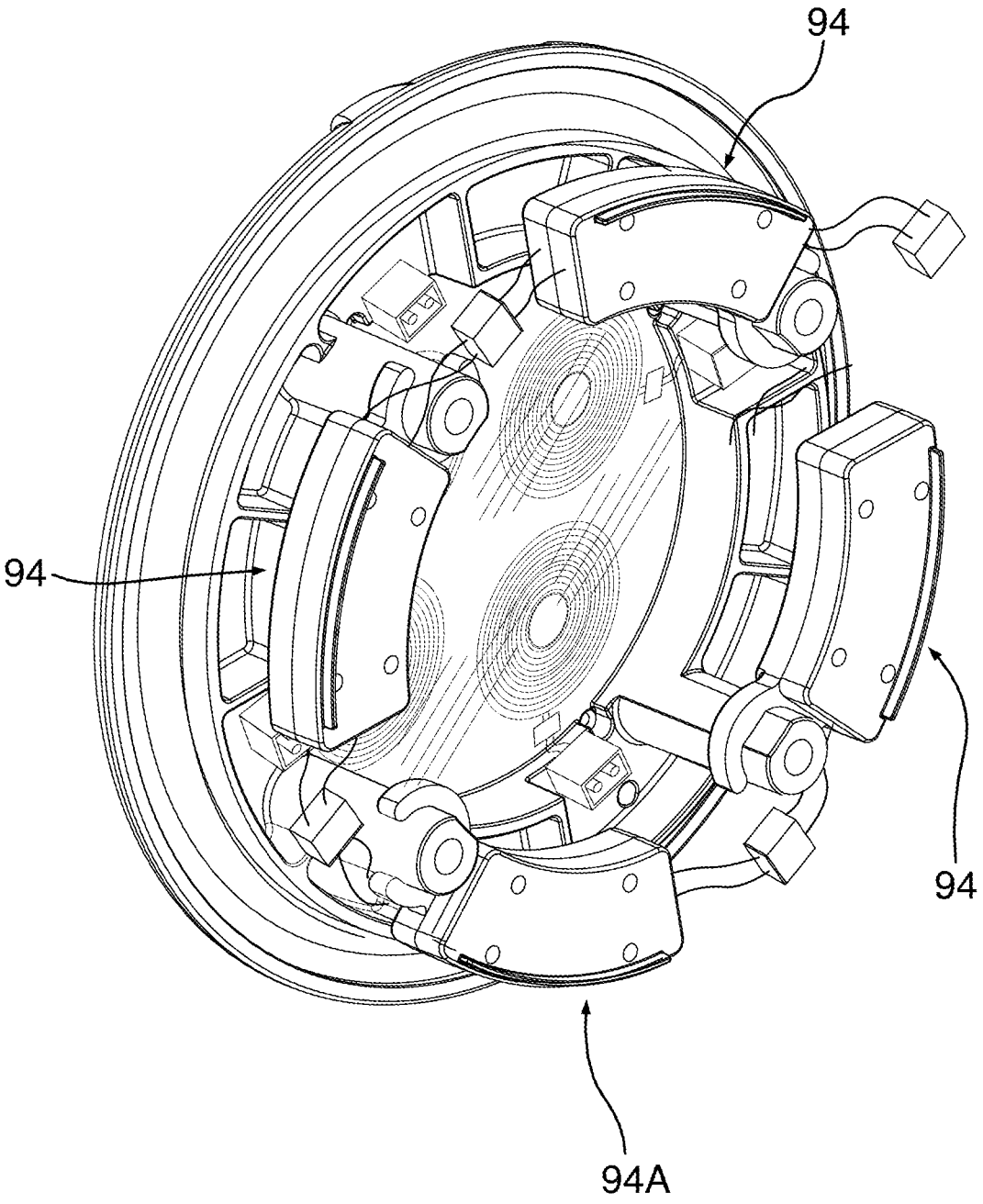
FIG. 17 is a view of another variation of the structure of FIG. 7.
Figure 18:
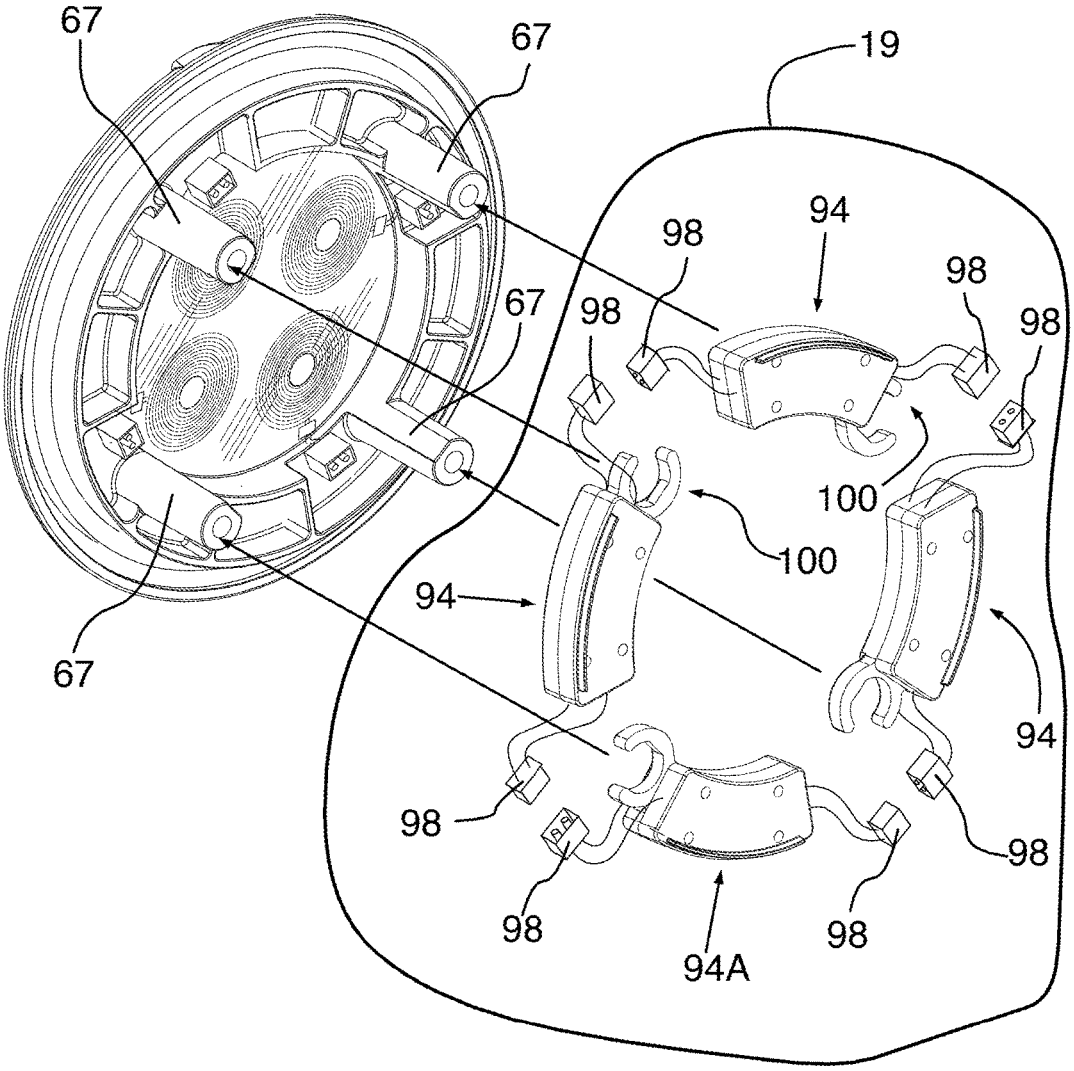
FIG. 18 is an exploded view of the structure of FIG. 17.
Figure 19:
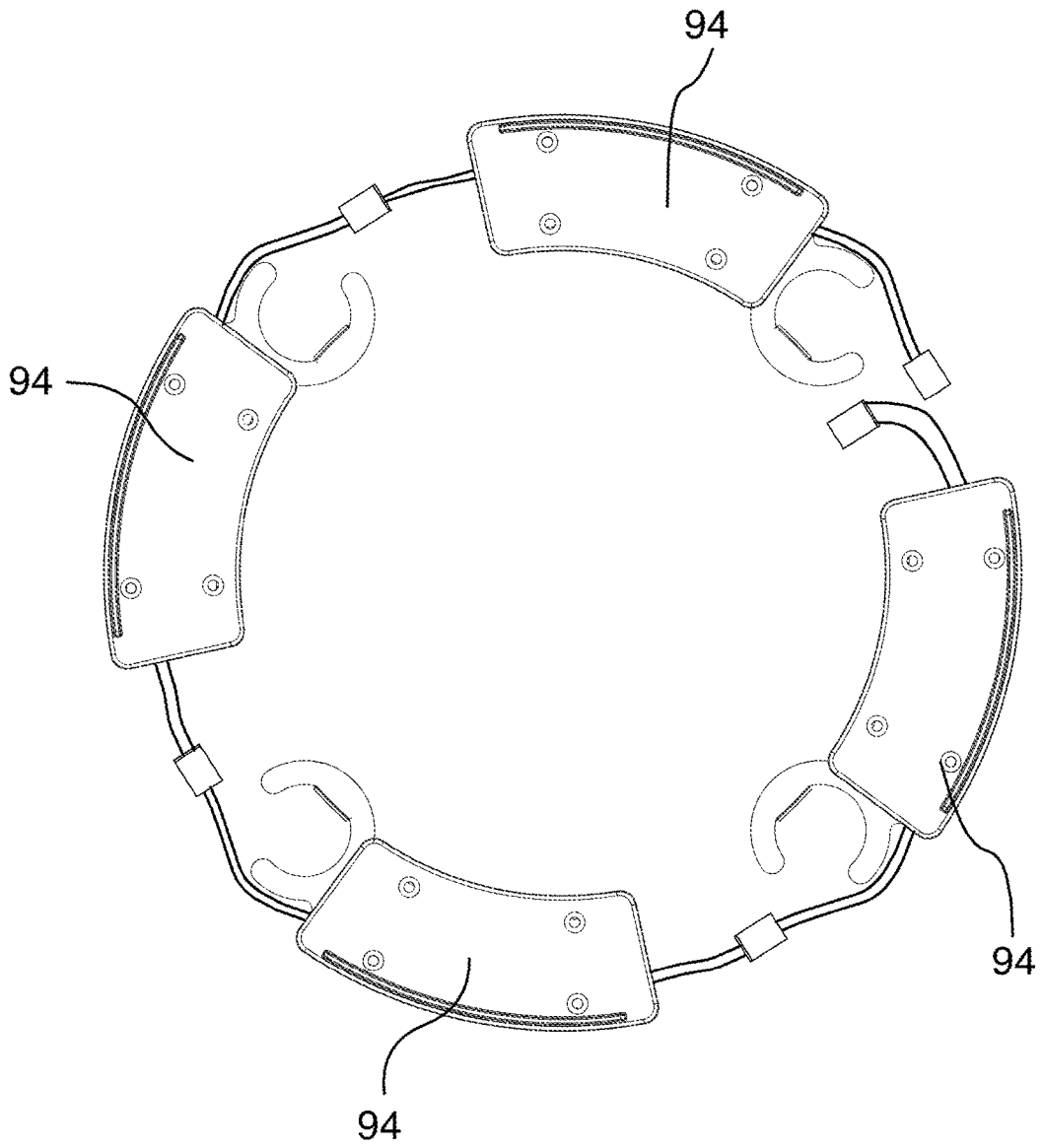
FIG. 19 is an enlarged view of a portion of the structure of FIG. 17.
Figure 20:
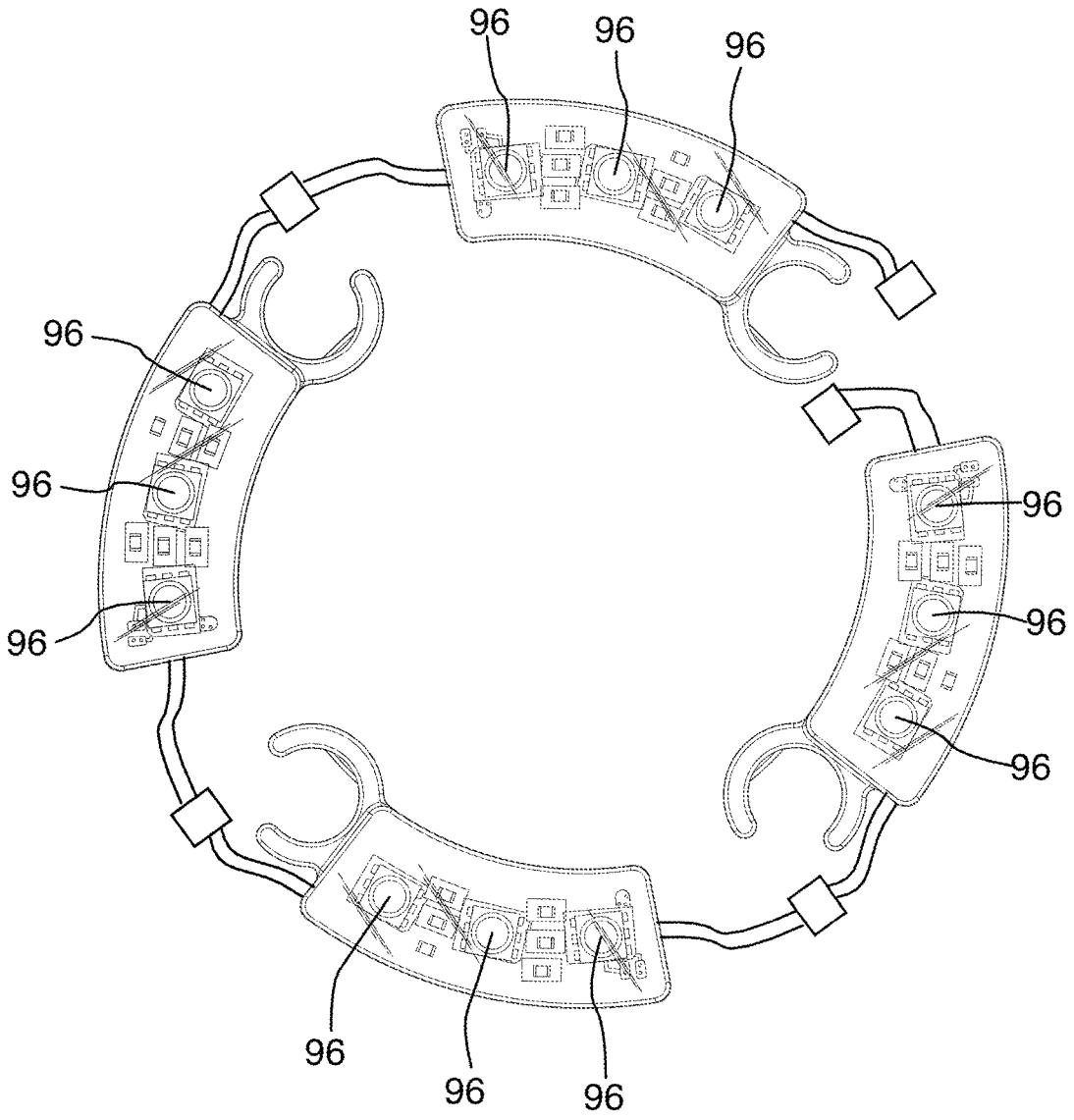
FIG. 20 is a view of the opposite side of the structure of FIG. 19.

This structure functions is a manner similar to that hereinbefore described, but differs in that the coils are flat coils 74A formed interiorly of a disc 80 which, as indicated by the sequence of FIGS. 14A-C, snap-fits into the cover portion by means of protuberances 82A formed on the periphery of the disc which engage hollows 82B in the cover. The coils terminate in plugs 84A which project from the disc and which, in this variation, engage receptacles 84B formed on a modified light part 32A to provide, in use, for an electrical connection between the coils 74A and the light part 32A; the light part 32A in this variant includes receivers 86A which can engage plug ends 86B of removable cords 88. Only three receivers 86A are shown; it will be understood that one of the flat coils in the disc, when connected, is coupled to the circuit board 68 to produce power for the lights 70; each of the other flat coils is coupled to respective one of the receivers 86A.

An advantage of this structure is that, in contrast to the tubular coils of FIGS. 1-10, wherein a load is borne by the motor whenever the coils are present, irrespective of load, in this structure, the motor only bears a load associated with a coil when the coil is coupled to a load.

Figure 9:
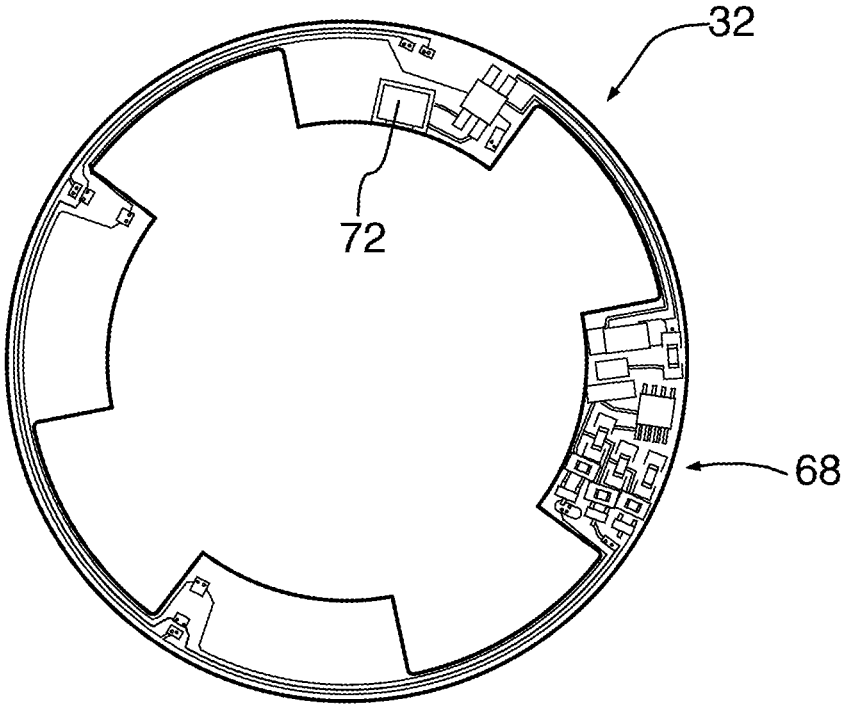
FIG. 9 is an enlarged view of a portion of FIG. 8.
Figure 10:
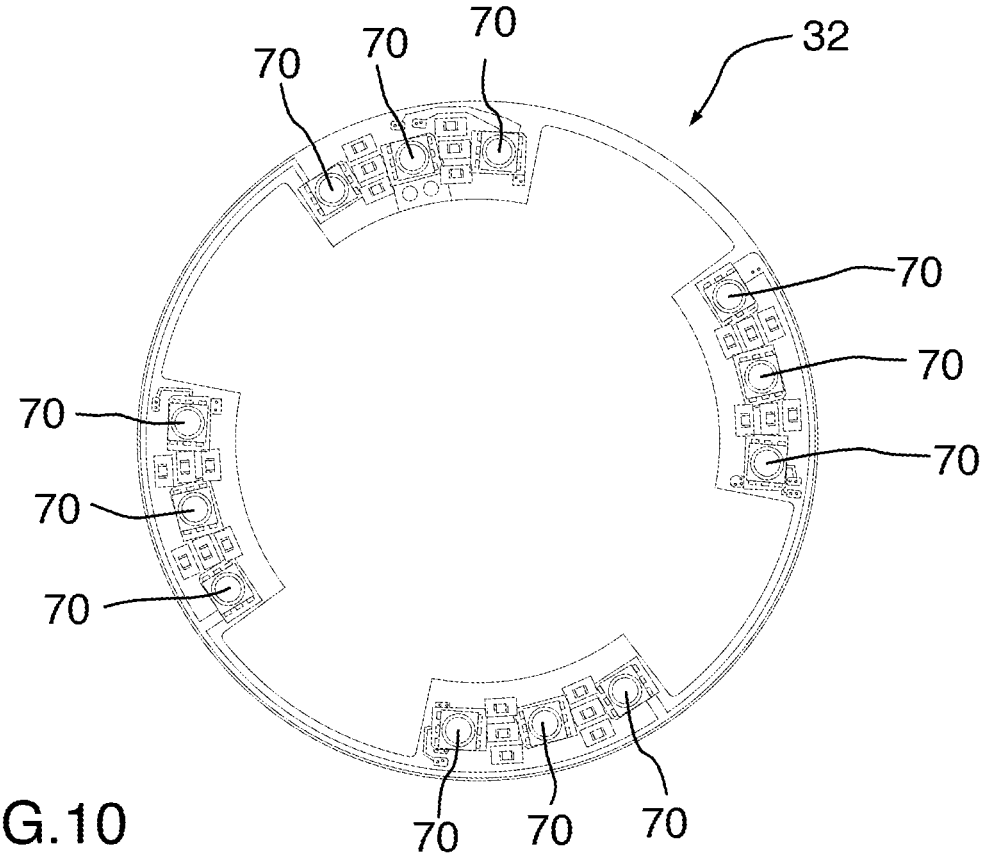
FIG. 10 is a rear view of the structure of FIG. 9.
Figure 21:
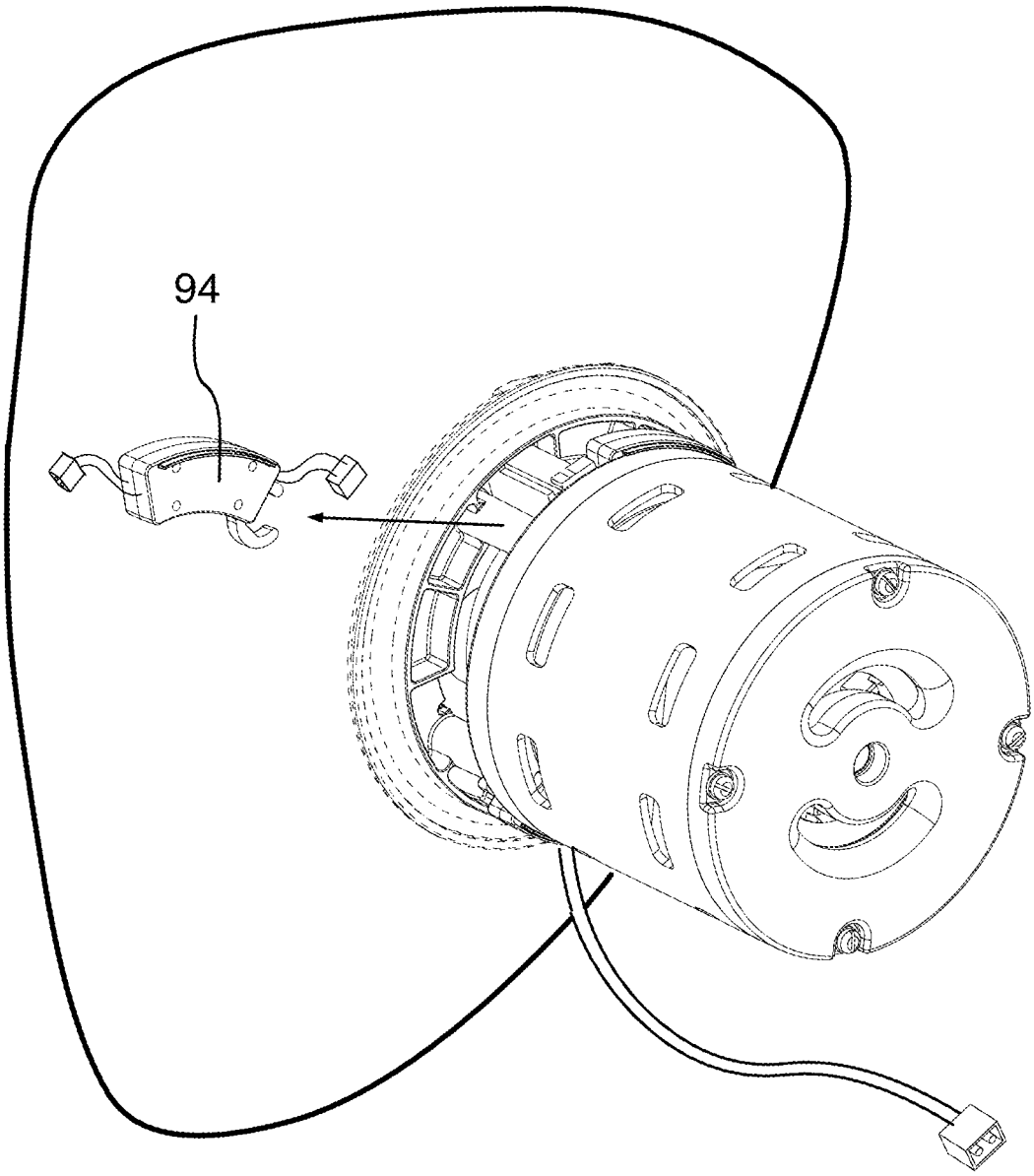
FIG. 21 is a partially disassembled view of an embodiment including the structure of i.

Yet another variant is shown in FIGS. 17-21. In this variant, the annular circuit board of FIG. 9-10 is replaced with a plurality of modules 94, each including a plurality of lights 96, a pair of plugs 98 and a clip 100, one of the modules 94A including a circuit board. In use, the clip 100 of each module is secured to one of the posts 67 and the modules are plugged together. This variants functions in a manner similar to the structure of FIGS. 1-16, but has the advantage in that, if the circuit board fails, the defective module(s) can be replaced without removal of the cover portion from the basin, as indicated by FIG. 21.

Other variations are possible.

For example, whereas in FIGS. 11A and 11B, the flat coils appear identical, coils can be varied; finer windings result in more wire length, higher voltages and reduced current whereas coarser windings result in higher current and lower voltage.

Yet further variants are possible. Accordingly, the invention should be understood to be limited only by the accompanying claims, purposively construed.

The invention claimed is:

1. An illuminated mount used in a foot spa, the foot spa having a surface defining a basin for containing water, a pump magnetically driven by rotating magnets and held against rotation by the mount which also defines part of the surface, the improvement comprising:

a coil associated with the mount and disposed exteriorly of the surface of the basin and interiorly of a magnetic field produced by the rotating magnets to produce a current;

a plurality of lights operatively connected to and powered by the coil;

a plurality of platforms defined on the mount with a circuit board releasably received by one of the plurality of platforms and operatively coupling the coil to the lights;

a cover portion of the mount with a first set of receivers that engage plugs on the circuit board, and the circuit board has a second set of receivers that engage plug ends of a set of removable cords; and wherein the mount is one of translucent or transparent to provide light conductivity to permit light from the plurality of lights to be visible interiorly of the basin.

2. The mount according to claim 1, wherein the mount includes a receiver and the coil is releasably received by the receiver.

3. The mount according to claim 1, wherein the coil is formed integrally with the mount.

4. An illuminated mount used in a foot spa, the foot spa having a surface defining a basin for containing water, a pump magnetically driven by rotating magnets and held against rotation by the mount which also defines part of the surface, the improvement comprising:

a coil associated with the mount and disposed exteriorly of the surface of the basin and interiorly of a magnetic field produced by the rotating magnets to produce a current;

a plurality of lights operatively connected to and powered by the coil, where each of the lights is associated with one of a plurality of modules, each module including a pair of plugs and a clip, one of the modules including a circuit board; and in use, the clip of each module is secured to a post of a set of the posts and the plurality of modules are plugged together; and wherein the mount is one of translucent or transparent to provide light conductivity to permit light from the plurality of lights to be visible interiorly in the basin.

* * * * *